US009897277B2

(12) United States Patent
Smith

(10) Patent No.: US 9,897,277 B2
(45) Date of Patent: Feb. 20, 2018

(54) SUN LIGHT FIXTURE

(71) Applicant: 3form, Inc., Salt Lake City, UT (US)

(72) Inventor: Ryan Grey Smith, Seattle, WA (US)

(73) Assignee: 3Form, LLC, Salt Lake City, UT (US)

( * ) Notice: Subject to any disclaimer, the term of this patent is extended or adjusted under 35 U.S.C. 154(b) by 0 days.

(21) Appl. No.: 13/855,539

(22) Filed: Apr. 2, 2013

(65) Prior Publication Data

US 2013/0265758 A1 Oct. 10, 2013

Related U.S. Application Data

(63) Continuation-in-part of application No. 29/425,976, filed on Jun. 28, 2012, now Pat. No. Des. 679,852.
(Continued)

(51) Int. Cl.
*F21V 11/00* (2015.01)
*F21V 5/00* (2018.01)
(Continued)

(52) U.S. Cl.
CPC ..... *F21V 5/00* (2013.01); *B44C 5/00* (2013.01); *F21S 8/061* (2013.01); *F21V 1/22* (2013.01);
(Continued)

(58) Field of Classification Search
CPC ..... F21V 3/0445; F21V 3/005; F21V 1/12; F21V 15/012; F21V 9/02; F21V 21/008;
(Continued)

(56) References Cited

U.S. PATENT DOCUMENTS 854,827 A * 5/1907 Kuhne ..... F21V 21/38 200/2
1,562,807 A * 11/1925 Thiel ..... B44C 1/18 29/460
(Continued)

FOREIGN PATENT DOCUMENTS

DE 2035091 A1 * 1/1972 ..... F21V 1/02
DE 102005020701 A1 * 11/2006

OTHER PUBLICATIONS

Mayer, Method of making one-piece, self-supporting lamp screen, by using inflatable, non-adhesive coated shaping body to which cord- or thread-like covering material, already applied with commercial adhesives, is taped, Nov. 2, 2006, English translation.*
(Continued)

*Primary Examiner* — Bryon T Gyllstrom
*Assistant Examiner* — James Endo
(74) *Attorney, Agent, or Firm* — Workman Nydegger

(57) ABSTRACT

Implementations of the present invention relate to systems, methods, and apparatus for illuminating and/or providing an aesthetically pleasing lighted structure. In particular, implementations of the present invention provide a light fixture, which can incorporate resin elements surrounding a lighted core. Additionally, one or more implementations also include methods of manufacturing the lighted fixture to achieve a desirable aesthetic thereof. Furthermore, in one or more implementations, the light fixture can resemble or imitate a sun, which can appeal to a viewer thereof.

26 Claims, 6 Drawing Sheets

Related U.S. Application Data

(60) Provisional application No. 61/621,901, filed on Apr. 9, 2012.

(51) Int. Cl.

| | |
|---|---|
| ***F21V 21/00*** | (2006.01) |
| ***B44C 5/00*** | (2006.01) |
| ***F21V 1/22*** | (2006.01) |
| ***F21V 1/26*** | (2006.01) |
| *F21S 8/06* | (2006.01) |
| *F21V 1/12* | (2006.01) |
| *F21V 1/14* | (2006.01) |
| *B44C 5/04* | (2006.01) |
| *F21V 21/008* | (2006.01) |
| *F21V 3/04* | (2018.01) |
| *F21W 121/00* | (2006.01) |
| *F21Y 115/10* | (2016.01) |

(52) U.S. Cl.
CPC ..... *F21V 1/26* (2013.01); *F21V 21/00* (2013.01); *B44C 5/0469* (2013.01); *F21S 8/068* (2013.01); *F21V 1/12* (2013.01); *F21V 1/143* (2013.01); *F21V 3/0436* (2013.01); *F21V 3/0445* (2013.01); *F21V 21/008* (2013.01); *F21W 2121/00* (2013.01); *F21Y 2115/10* (2016.08); *Y10T 29/49826* (2015.01)

(58) Field of Classification Search
CPC . F21V 3/03; F21V 3/023; F21V 3/049; F21V 8/026; F21V 8/061; F21V 8/068; F21V 3/026; F21V 3/0436; F21V 3/0454; F21V 3/0463; F21V 1/143; F21V 1/146; F21V 1/18; F21V 1/22; F21V 1/14; F21V 1/16; F21V 1/26; F21V 21/104; F21V 8/065; F21V 17/002; F21V 17/007; F21V 17/06; F21V 17/08; Y10S 362/806; F21W 2121/00; F21W 2121/004; F21S 8/061; F21S 13/10; F21S 13/08; F21S 13/06; F21S 13/04; F21S 13/02; F21S 8/06; F21S 8/026; F21S 8/068; F21S 8/065; B44C 5/005; B44C 5/08; B44C 5/0469; B44C 5/00; B44C 1/18; B44C 1/20; A41G 1/004; A41G 1/005; B29C 66/246
USPC .... 362/355, 311.13, 249.06, 249.14, 249.15, 362/268, 292, 311.04, 311.06, 331, 332, 362/352, 311.14, 311.15, 311.03, 311.02, 362/311.01, 255, 256, 351, 354, 356, 357, 362/358, 360, 361; D26/118, 86, 88, 89, D26/90, 91, 119, 128, 129, 130; 428/378; 264/295, 322; 156/250
See application file for complete search history.

(56) References Cited

U.S. PATENT DOCUMENTS

| | | | | | |
|---|---|---|---|---|---|
| 1,861,604 | A | * | 6/1932 | Loring | B44C 5/00 362/806 |
| 2,212,638 | A | * | 8/1940 | Franke Edward P | A41G 1/00 428/11 |
| D183,973 | S | * | 11/1958 | Navratil | D26/131 |
| 2,916,608 | A | * | 12/1959 | Brown | F21S 6/002 362/122 |
| D191,678 | S | * | 10/1961 | Kaufmann | D26/131 |
| 3,334,222 | A | * | 8/1967 | Ziegler | F21V 1/00 362/328 |
| 3,433,939 | A | * | 3/1969 | Lothman | 362/644 |
| 3,479,501 | A | * | 11/1969 | Pisciotta et al. | 362/355 |
| 3,600,572 | A | * | 8/1971 | Grunwald | F21V 1/00 362/358 |
| 3,791,899 | A | * | 2/1974 | Walters | B44C 1/04 156/152 |
| D240,852 | S | * | 8/1976 | Jacobsen | D26/86 |
| 4,364,102 | A | * | 12/1982 | Huppert | A47G 33/06 362/122 |
| 5,609,929 | A | * | 3/1997 | Huang | B44C 5/00 428/11 |
| 5,772,312 | A | * | 6/1998 | Pihl-Niederman | A47G 33/06 362/238 |
| 6,103,352 | A | * | 8/2000 | Takahashi | B32B 27/00 428/195.1 |
| 6,394,620 | B1 | * | 5/2002 | Wang | F21V 3/023 362/121 |
| D538,962 | S | * | 3/2007 | Elliott | D26/88 |
| D570,526 | S | * | 6/2008 | Cenedese | D26/88 |
| D597,244 | S | * | 7/2009 | Trumble et al. | D26/90 |
| D604,451 | S | * | 11/2009 | Smith | D26/118 |
| D604,452 | S | * | 11/2009 | Smith | D26/118 |
| D604,890 | S | * | 11/2009 | Smith | D26/118 |
| D612,531 | S | * | 3/2010 | Smith | D26/137 |
| D620,636 | S | * | 7/2010 | Holder | D26/127 |
| 2002/0160680 | A1 | * | 10/2002 | Laurence | B32B 27/36 442/394 |
| 2003/0081418 | A1 | * | 5/2003 | Sviland | 362/356 |
| 2003/0091758 | A1 | * | 5/2003 | Osumi | B32B 17/06 428/34 |
| 2004/0170022 | A1 | * | 9/2004 | Yoshimori et al. | 362/431 |
| 2005/0141214 | A1 | * | 6/2005 | Fotherby | 362/122 |
| 2005/0231975 | A1 | * | 10/2005 | Bixler | A47G 33/08 362/565 |
| 2006/0027311 | A1 | * | 2/2006 | Weder | B01J 19/0093 156/160 |
| 2006/0146525 | A1 | * | 7/2006 | Chernick | A63B 43/06 362/196 |
| 2007/0153540 | A1 | * | 7/2007 | Lin | 362/565 |
| 2007/0230189 | A1 | * | 10/2007 | Gruenbacher et al. | 362/311 |
| 2008/0030995 | A1 | * | 2/2008 | Chen | 362/360 |
| 2009/0072444 | A1 | * | 3/2009 | Leng | B29C 39/10 264/319 |
| 2009/0086494 | A1 | * | 4/2009 | Kenney | 362/356 |
| 2010/0097814 | A1 | * | 4/2010 | Lederer | 362/392 |
| 2010/0142209 | A1 | * | 6/2010 | Cuppett et al. | 362/311.08 |
| 2011/0063845 | A1 | * | 3/2011 | Myers et al. | 362/249.16 |
| 2011/0188228 | A1 | * | 8/2011 | Li | 362/84 |
| 2011/0242817 | A1 | * | 10/2011 | Chowdhury et al. | 362/294 |

OTHER PUBLICATIONS

DE2035091A1, Jan. 20, 1972, English translation.*

* cited by examiner

SUN LIGHT FIXTURE

CROSS-REFERENCE TO RELATED APPLICATIONS

The present application claims the benefit of priority to U.S. Provisional Patent Application No. 61/621,901, filed Apr. 9, 2012, entitled "Sun Light Fixture." The present application is also a continuation-in-part of U.S. Design patent application Ser. No. 29/425,976, filed Jun. 28, 2012, entitled "Sun Lighting Fixture." The entire contents of the above-referenced applications are incorporated herein by this reference.

BACKGROUND OF THE INVENTION

1. The Field of the Invention

Implementations of the present invention relate to decorative resin lighting fixtures.

2. Background and Relevant Art

Recent trends in building design involve using one or more sets of decorative panels to add to the functional and/or aesthetic characteristics of a given structure or design space. These recent trends are due, at least in part, because there is sometimes more flexibility with how the given panel (or set of panels) is designed, compared with the original structure. For example, recent panel materials include synthetic, polymeric resin materials, which can be formed as panels to be used as partitions, walls, barriers, treatments, décor, etc.

In particular, the use of resin materials is becoming increasingly popular in sculptural and lighting applications. In general, resin materials such as these are now popular compared with decorative cast or laminated glass materials, since resin materials may be manufactured to be more resilient and to have a similar transparent, translucent, or decorative appearance as cast or laminated glass, but with less cost. In addition, resin materials tend to be more flexible in terms of manufacture and assembly because they can be relatively easily bent, molded, colored, shaped, cut, and otherwise modified in a variety of different ways. Decorative resins can also provide more flexibility compared with glass and other conventional materials at least in terms of color, degree of texture, gauge, and impact resistance. Additionally, decorative resins have a fairly wide utility since they may be formed to include a large variety of colors, images, inter-layers, and shapes.

Some lighting fixtures made with resin materials are designed to allow for quick, efficient, and inexpensive production. However, the design of such resin-based lighting fixtures may not focus on, or even allow for, full utilization of the aesthetics that resin-based materials can provide. Along similar lines, many resin-based lighting fixtures are designed for mass production. Mass produced resin-based lighting fixtures, while being relatively inexpensive, can lack uniqueness. Other lighting fixtures made with resin materials are so unique that they typically cannot be mass produced on any appreciable level without making such unique lighting fixtures costly.

Furthermore, some lighting fixtures made with resin materials do not deliver appropriate light distribution. An inappropriate light distribution can emphasize particularly unappealing features and fail to provide sufficient emphasis on certain desirable features of the light fixture and/or of the surrounding area.

Accordingly, there are a number of disadvantages in resin-based lighting fixtures that can be addressed.

BRIEF SUMMARY OF THE INVENTION

Implementations of the present invention provide systems, methods, and apparatus for illuminating and/or providing an aesthetically pleasing lighted structure. In particular, implementations of the present invention provide a light fixture, which can incorporate resin elements surrounding a lighted core. Additionally, one or more implementations also include methods of manufacturing the lighted fixture to achieve a desirable aesthetic thereof. Furthermore, in one or more implementations, the light fixture can resemble or imitate a sun, which can appeal to a viewer thereof.

One or more implementations include a resin-based light fixture that includes a frame including a plurality of structural members that define an internal volume of the frame and one or more lighting elements secured within the internal volume of the frame. In addition, the resin-based light fixture includes one or more diffusers secured to the frame in a manner that the one or more diffusers at least partially surround the one or more lighting elements. Also, the resin-based light fixture includes a plurality of fins secured to one or more of the frame and the one or more diffusers, the plurality of fins extending outward from the one or more diffusers, and the plurality of fins including one or more bends or twists.

Additional or alternative implementations include an illuminated resin-based light fixture having a non-uniform illumination intensity. The illuminated resin-based light fixture incorporates a lighted core including a frame having one or more illuminated lighting elements secured within the frame. Additionally, the lighted core includes one or more diffusers secured to one or more of an outside and an inside of the frame. The illuminated resin-based light fixture also includes a plurality of resin fins positioned about the lighted core. Furthermore, the lighted core has a first color and a first intensity of illumination, while at least a portion of each of the plurality of resin fins has a second color and a second intensity of illumination. In addition, the first intensity of illumination is different from the second intensity of illumination.

Implementations also include a method of manufacturing a resin-based light fixture. The method includes forming a frame that includes a plurality of structural members connected together to form an internal volume of the frame. The method also includes securing a lighting assembly within the internal volume of the frame and securing one or more diffusers to the frame in a manner that the one or more diffusers at least partially surround the lighting assembly. Moreover, the method includes securing one or more fins to one or more of the frame and the one or more diffusers and shaping the one or more fins to include one or more bends twists.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention provide systems, methods, and apparatus for illuminating and/or providing an aesthetically pleasing lighted structure. In particular, implementations of the present invention provide a light fixture, which can incorporate resin elements surrounding a lighted core. Additionally, one or more implementations also include methods of manufacturing the lighted fixture to achieve a desirable aesthetic thereof. Furthermore, in one or more implementations, the light fixture can resemble or imitate a sun, which can appeal to a viewer thereof.

One will appreciate in light of the disclosure herein that one or more implementations of the present invention can provide aesthetically pleasing light fixtures. For instance, one or more implementations can include resin-based lighting fixtures that may have hand-shaped elements, forming aesthetically pleasing configurations. Furthermore, the resin-based light fixtures can help magnify the aesthetic features of the resin materials used to form the light fixtures. Indeed, one or more implementations may help magnify the form, texture, color(s), transparency, and other features of the resin materials. In addition, one or more implementations can reduce or eliminate visibility of hardware that could otherwise detract from the aesthetics provided by the resin materials.

Moreover, in at least one implementation, the resin-based light fixtures can comprise a frame that can support decorative and/or functional light fixture elements. For instance, the light fixture can include one or more thermoplastic resin panels or strips and a lighting assembly that illuminates the resin-based light fixture as well as providing illumination to a surrounding area. Moreover, the resin-based light fixture can include thermoplastic resin panels or strips that can provide structural support to other elements of the resin-based light fixture and/or can diffuse light emitted by the lighting elements.

Figure 1:
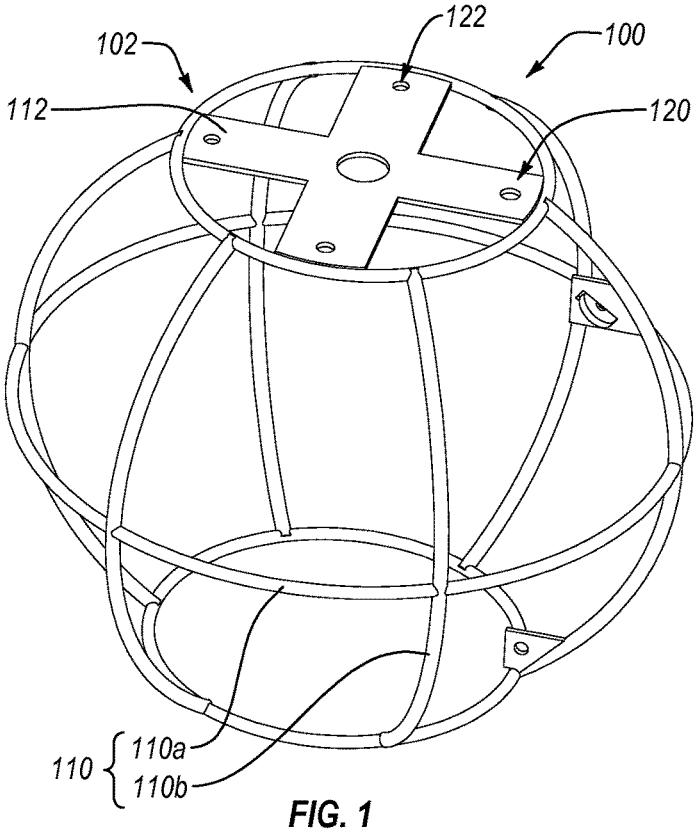
FIG. 1 illustrates a perspective view of a frame of a resin-based light fixture in accordance with one implementation of the present invention.

For example, the resin-based light fixture can include a frame 100, as illustrated in FIG. 1. The frame 100 can have various shapes and dimensions, which may vary from one implementation to another. In one implementation, the frame 100 can have substantially the same dimensions from a center point thereof to exterior points or portions thereof—i.e., the frame 100 can conform with or define an imaginary sphere (or a spherical surface). In one or more examples, only a portion of the frame 100 may define a portion of a sphere (e.g., a top portion of the frame 100 may define or conform with an imaginary hemispherical surface.

The frame 100 also may include flat areas 102. For instance, the frame 100 that conforms with a sphere may have flattened poles. In one more implementations, the frame 100 may have two, opposing flat areas 102. In additional or alternative implementations, the frame 100 may include a single flat area or any number of flat areas (e.g., three, four, etc.). In any event, the flat area(s) 102 may provide one or more areas or surfaces for positioning or affixing the frame 100 to a support surface.

Additionally, such flattened poles also can facilitate access to one or more elements that the frame 100 may contain therein. Specifically, the frame 100 can form substantially any three-dimensional shape. For instance, the frame 100 can have a cube-like shape, a rectangular-shape, a cylinder-like shape, an irregular three-dimensional shape, etc.

In any case, the frame 100 may have an internal volume and may house as well as provide support to internal elements or components, as described in further detail below. Likewise, the frame 100 may support and/or couple any number of external elements or components that may be mounted on or coupled to the frame 100 to form the resin-based light fixture. As noted above, the flat area(s) 102 may facilitate access to the internal elements or components located inside the frame 100.

The frame 100 may have a diameter of about 30" (e.g., the distance from the center of the frame 100 to outside points or portions thereof may be approximately 15"). The flat areas 102 of the frame 100 may have a width of approximately 13". It should be noted, however, that such dimensions of the frame 100 are illustrative of one or more particular implementations of the invention and should not be considered as limiting.

Furthermore, the frame 100 can incorporate a plurality of structural members 110, which can define the overall shape of the frame 100 as well as form the internal volume thereof. For example, the frame 100 can include one or more longitudinal structural members 110*a* and one or more lateral structural members 110*b*, which can define the shape of the frame 100, as described above. Furthermore, the frame 100 can incorporate one or more structural members 110 that can have various positions and orientations relative to each other. In other words, the structural members 110 can form acute and/or obtuse angles with respect to each other and may not be positioned along longitudinal and/or lateral axes.

In at least one implementation, one or more of the structural members 110 can have an at least partially arcuate form, such as, for example, to provide the frame 100 with a substantially spherical shape, when joined or coupled one to another. In particular, the longitudinal structural members 110*a* can have an arcuate shape with substantially the same radius. Similarly, the lateral structural members 110*b* also can have an arcuate shape with a matching radius. Accordingly, once combined into the frame 100, the longitudinal structural members 110*a* and lateral structural members 110*b* can form an approximately spherical shape.

Alternatively, the structural members 110 can have other shapes and/or sizes, in combination, to form other shapes of the frame 100. In one or more implementations, one or more of the structural members 110 forming the frame 100 can have substantially straight shapes. The structural members 110 also can have a curved shape, twisted shape, an irregular shape, and a variety of other shapes, which should be appreciated in light of this disclosure.

Furthermore, structural members 110 can have various cross-sections and may comprise one or more suitable materials. In one example, the structural members 110 may comprise a tubular material that may be shaped or bent to desired configuration(s) to form the frame 100. More specifically, the manufacturer can use round, square, or other tubular materials to fabricate the structural members 110. For instance, a manufacturer can use standard tubular shapes to form the structural members 110. Alternatively, the structural members 110 can comprise solid material (e.g., solid bars), which the manufacturer can shape into desired shapes.

The manufacturer also can use a variety of suitable materials to make the structural members 110. In particular, the structural members 110 can comprise steel, aluminum alloys, copper alloys, zinc alloys, wood, thermoplastics, and other sufficiently rigid materials. The manufacturer can select the appropriate material and/or cross-sectional shape and dimensions of the structural members 110 based on the size, shape, weight, and other physical characteristics intended for the resin-based light fixture. The material for the structural members 110 as well as the size and shape of their cross-section also can be chosen, at least in part, based on the physical characteristics of the elements that the manufacturer will secure, couple, or mount on the frame 100.

In one implementation, the structural members 110 may comprise an opaque material such as steel or aluminum. In additional or alternative implementation, the structural members 110 may comprise transparent or translucent material. Furthermore, implementations may include structural members 110 that partially comprise an opaque material and partially comprise a transparent or translucent material.

In any case, implementations may include the frame 100 that allows light to pass from the inside thereof to the outside thereof. For example, the structural members 110 may be spaced apart from each other in a manner that allows light to pass from an internal portion of the frame 100 out of the frame 100 (i.e., the light may pass between the structural members 110). In additional or alternative implementations, as noted above, the frame 100 may include at least partially transparent or translucent structural members 110, such that at least some of the light from the inside of the frame 100 may pass through one or more transparent or translucent structural members 110.

As described above, the structural members 110 can combine to form the frame 100 of a desired shape, size, and/or configuration (e.g., spacing between structural members 110, orientations of the structural members 110, etc.). In at least one implementation, the manufacturer can couple the structural members 110 one to another using suitable fastener or coupling mechanisms. For instance, the manufacturer can weld or glue the structural members 110 to each other. Alternatively, the manufacturer can couple the structural members 110 with mechanical fasteners, such as screws, rivets, staples, nails, etc. Furthermore, the manufacturer can use movable mechanical fasteners or connectors, such as hinges, slides, pistons, etc., to couple the structural members 110 one to another.

In one or more implementations, the manufacturer can couple or connect each of the structural members 110 at each intersecting structural member 110. Alternatively, the structural members 110 can connect together at desired locations and to other structural members 110. Additionally, the structural members 110 can abut, pass through, and/or pass around other structural members 110 at various intersections thereof.

As explained above, the spherical frame 100 can include one or more flattened poles that may facilitate placing or securing the frame and/or the resin-based light fixture on or to the support surface. In one implementation, a flattened pole of the frame 100 can include one or more straight (or flat) structural members 112. Particularly, the structural members 112 can form crossbars 120, which may at least in part form or define the flat areas 102. In one example, the crossbars 120 can form a top and/or bottom poles of the spherical frame 100.

Furthermore, the crossbars 120 can allow the manufacturer to secure one or more components or elements of the resin-based light fixture to the frame 100 thereof. For example, the crossbars 120 can include holes or openings 122 that can allow the manufacturer to secure various elements and components to the crossbars 120. Likewise, the crossbars 120 and/or the openings 122 therein can facilitate securing of the frame 100 as well as the resin-based light fixture to a support surface, as further described below.

Figure 2A:
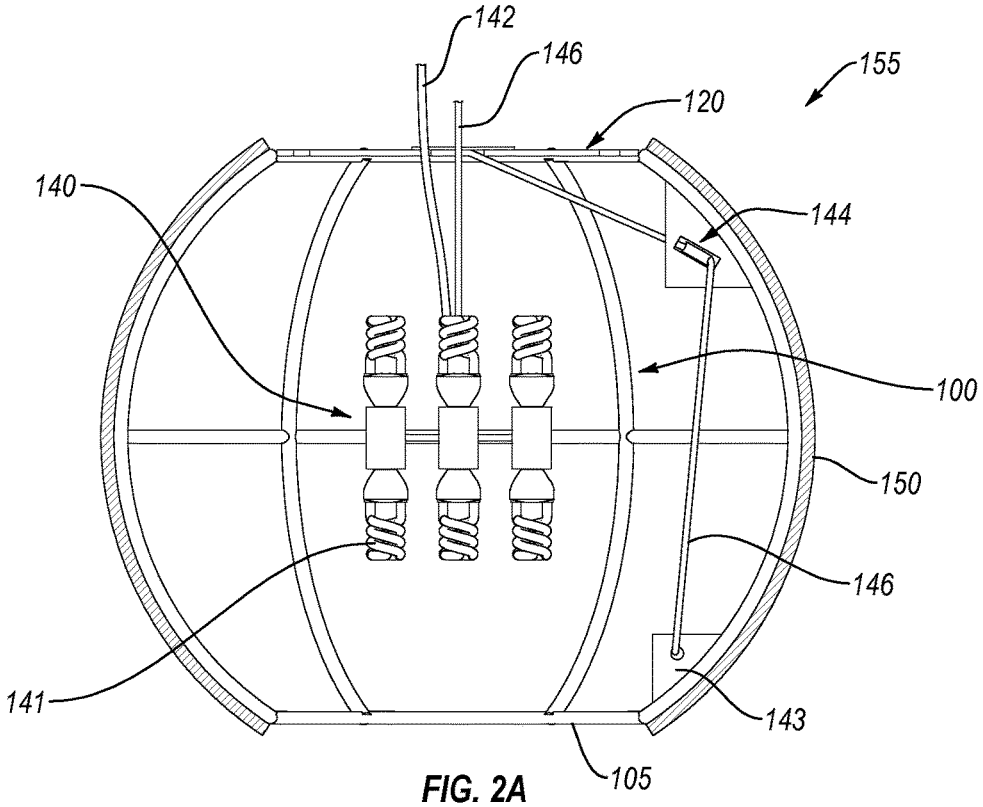
FIG. 2A illustrates a cross-sectional view of a lighted core of the resin-based light fixture in accordance with one implementation of the present invention.

In at least one implementation, the resin-based light fixture can include a lighted core 155, illustrated in FIG. 2A. The lighted core 155 may include the frame 100, a lighting assembly 140, one or more diffusers 150, and combinations thereof. The lighting assembly 140 can at least partially illuminate the resin-based light fixture and/or area surrounding the resin-based light fixture.

For instance, the lighting assembly 140 may include one or more lighting elements 141 that may produce visible light. The lighting elements 141 can include any type of element capable of producing visible light. For example, lighting elements 141 can comprise incandescent, fluorescent (e.g., CFL), and/or LED light bulbs. The lighting elements 141 also can include neon or other strip lights, as well as other lighting elements 141 configurations.

In one example, the lighting assembly 140 may be coupled to a power cable 142. The power cable 142 may supply power to the lighting elements 141. In addition, the power cable 142 may secure the lighting assembly 140 to the frame 100 (e.g., to the crossbars 120). It should be appreciated that the lighting assembly 140 may connect and be secured to the frame 100 in any number of ways, which may vary from one implementation to the next. For instance, a cable 146 can connect and secure the lighting assembly 140 to the frame 100, as described below.

In at least one implementation, the lighting assembly 140 and/or the lighting elements 141 can facilitate replacement of the lighting elements 141. For instance, a lower portion of the resin-based light fixture can include an access door 105, which may be masked and/or covered by one or more diffusers 150 and/or one or more other elements (e.g., fins, described below). The access 105 door can provide access to the lighting elements 141 of the lighting assembly 140, which may be located inside the frame 100. In particular, the access door 105 can allow a technician to access and replace the lighting elements 141.

According to one or more implementations, the resin-based light fixture can include a lowering pulley system, which can allow the technician to lower the lighting assembly 140 and/or lighting elements 141 from the resin-based light fixture. In particular, the lowering pulley system can include an anchor 143, a pulley 144, and a cable 146. At a first end, the cable 146 can couple to the anchor 143. The cable 146 also can pass through the pulley 144 and couple to the lighting assembly 140 and/or lighting elements 141. Furthermore, at a second end (opposite to the first end) the cable 146 can couple to a second anchor or a fixture (i.e., in an anchored position of the cable 146) located outside of the resin-based light fixture, such as to prevent the cable 146 from movement. For instance, the second end of the cable 146 can connect to or near the support surface that secures the resin-based light fixture. As such, the technician may have access to the second end of the cable 146, which allow the technician to disconnect and/or to reconnect the second end of the cable 146 to the second anchor or fixture.

Accordingly, to lower the lighting assembly 140 and/or lighting elements 141 from the resin-based light fixture, the technician can release (or disconnect) and reposition the second end of the cable 146, such that the lighting assembly 140 and/or lighting elements 141 can lower from the resin-based light fixture. Additionally, lowering the lighting assembly 140 and/or lighting elements 141 also can open the access door 105. For instance, the access door 105 also can couple to the cable 146, such that release or repositioning of the second end of the cable 146 can open the access door 105, and returning the cable 146 to its anchored position can close the access door 105. Hence, the technician can lower the lighting assembly 140 and/or lighting elements 141 and open the access door 105 by releasing and/or repositioning the second end of the cable 146. Moreover, after replacing the lighting elements 141, the technician can raise the lighting assembly 140 and/or lighting elements 141 to the original position thereof, within the resin-based light fixture and close the access door 105 by returning the second end of the cable 146 into its anchored position.

In one or more implementations, one or more elements or components of the resin-based light fixture can at least partially conceal the lighting elements 141, in a manner that the lighting elements 141 may not be individually identifiable as the sources of light that illuminates the resin-based light fixture and/or the surrounding area. For instance, the resin-based light fixture can include one or more diffusers 150, which may conceal the lighting assembly 140 and/or the lighting elements 141. In at least one implementation, the diffusers 150 may couple or connect to the frame 100 of the resin-based light fixture.

In addition to at least partially concealing the lighting assembly 140 and/or the lighting elements 141, the diffusers 150 can allow the light produced by the lighting assembly 140 to spread or diffuse across a surface or an area, instead of appearing to the viewer concentrated at one or more locations. Such diffusion can create a desirable aesthetic appeal for the resin-based light fixture as well as for the area lighted and/or decorated by the resin-based light fixture. For example, the diffusers 150 can comprise transparent and/or translucent material that can spread out and/or scatter light emitted by the lighting elements 141 (which may be relatively concentrated), in a manner that conceals or obscures the lighting elements 141. In one implementation, the diffusers 150 can include a layer or a coating that can scatter or diffuse light. Additionally or alternatively, the diffusers 150 may include texture, pattern, indents, and similar features and combinations thereof that may produce multiple facets, which can redirect and scatter or diffuse the light emitted by the lighting elements 141.

In one or more implementations, the manufacturer can form the diffusers 150 from a translucent material, such as translucent suede or a similar material. Additionally or alternatively, diffusers 150 can include one or more thermoplastic resin sheets (described below). The term "resin," as used herein, refers to panels, strips, sheets, and/or other two- or three-dimensional configurations comprising one or more thermoplastic polymers. Specifically, such materials can include, but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), or the like.

Additionally or alternatively, the diffusers 150 may have any suitable or desirable color, which may change from one implementation to another. Furthermore, the diffusers 150 may include multiple colors and/or any number of desirable or suitable patterns thereon. Accordingly, the diffusers 150 can filter the light emitted by the lighting elements in a manner that allows only a particular wavelength or wavelengths of light to pass through the diffusers 150. In other words, the diffusers 150 can make the light emitted by the lighting elements 141 appear to the viewer in any one or more desirable colors.

Figure 2B:
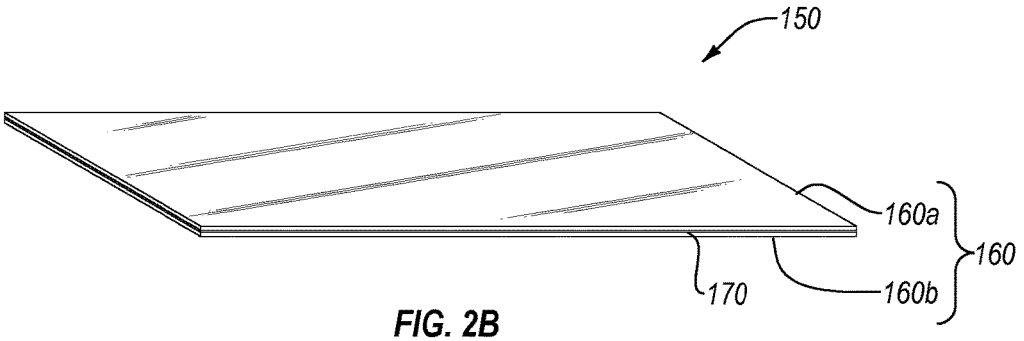
FIG. 2B illustrates a perspective view of a diffuser in accordance with one implementation of the present invention.

In one implementation, as illustrated in FIG. 2B, any of the diffusers 150 may include thermoplastic resin that has one or more layers. For example, the diffusers 150 can comprise an outer or an inner thermoplastic resin sheet 160 (e.g., thermoplastic resin sheet 160*a*) and a layer of translucent material 170. The diffusers 150 also can comprise the outer and inner thermoplastic resin sheets 160*a*, 160*b* and a translucent material 170 (e.g., translucent suede) between the outer and inner thermoplastic resin sheets 160*a*, 160*b*.

The manufacturer can laminate the outer and inner thermoplastic resin sheets 160*a*, 160*b*, thereby encasing or encapsulating the translucent material within a solid sheet or panel of thermoplastic resin. Furthermore, the thermoplastic diffusers 150 also can have various textures and/or formations on one or more surfaces thereof, which can enhance the diffusive properties of the diffusers 150. For example, the manufacturer can sand the thermoplastic resin sheet with fine sandpaper, to create a matte or dull surface thereon. Additionally or alternatively, the manufacturer can form single- or multi-faceted depressions and/or protrusion on one or more surfaces of the thermoplastic resin sheet(s) forming the diffusers 150.

In one or more implementations, the diffusers 150 can couple to the frame 100 (FIG. 2A). For example, the diffusers 150 can couple to the structural members of the frame. In particular, the diffusers 150 can substantially follow the contour or shape of the frame, such that the diffusers 150 form a shape that is substantially the same as the shape formed by the frame. Alternatively, the diffusers 150 can couple to the frame to form a shape that is different from the shape of the frame.

Figure 2C:
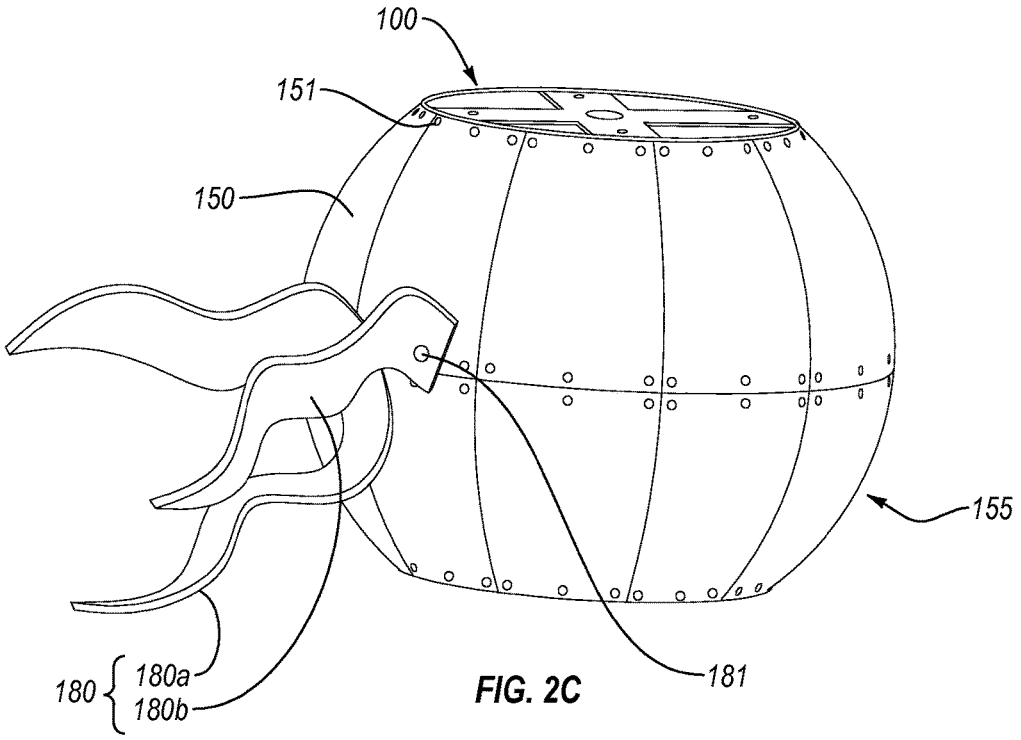
FIG. 2C illustrates a perspective view of a lighted core with fins in accordance with one implementation of the present invention.

In one implementation, as illustrated in FIG. 2C, the manufacturer can secure the diffusers 150 to the outside of the frame 100. For example, the manufacturer can fasten the diffusers 150 to the frame 100 with one or more fasteners 151, such as rivets, screws, bolts, and the like. Alternatively or additionally, the manufacturer can secure the diffusers 150 to the frame 100 with adhesives such as glue, epoxy, etc. In one or more implementations, the manufacturer can weld the diffusers 150 to the frame 100 (e.g., ultrasonically weld a resin-based diffusers 150 to a resin-based frame 100).

Implementations also may include the diffusers 150 secured inside the frame 100. In one example, the diffusers 150 may be secured both on the inside and on the outside of the frame 100. For example, some of the diffusers 150 may be secured on the inside of the frame 100, while other diffusers 150 may be secured on the outside of the frame 100. In one instance, the diffusers 150 may cover the frame 100 both on the inside and on the outside, thereby producing a diffuser that may have two layers, where a first layer of the diffuser is formed by the diffusers 150 secured on the outside of the frame 100, while the second layer is formed by the diffusers 150 secured on the inside of the frame 100. It should be appreciated that diffusers 150 may be secured on the inside and/or on the outside of the frame 100 in any number of suitable configurations or patterns, which may vary from one implementation to another.

In at least one implementation, the manufacturer can position one or more diffusers 150 (e.g., inner diffusers) within the frame 100. In particular, the inner diffusers 150 can form, for example, a substantially cylindrical shape around the lighting assembly. Accordingly, the manufacturer can regulate the distance at which to commence diffusing light produced by the lighting assembly as well as the amount of diffusion that the diffusers 150 can provide. Furthermore, the diffusers 150 can reduce the intensity of the light produced by the lighting assembly. Thus, by varying the number, location, translucent and diffusive properties of the diffusers 150, the manufacturer can achieve a desired illumination of the resin-based light fixture and/or of the surrounding area.

In addition to or in lieu of diffusing the light emitted by the lighting elements, the diffusers 150 also can provide structural rigidity and/or stiffness to the frame 100. Furthermore, in one implementation, the diffusers 150 may be secured one to another (e.g., with fasteners, adhesives, welding, etc.) to further increase the strength of the structure formed by the diffusers 150 and frame 100. In any event, when secured to the frame 100, the diffusers 150 can increase structural integrity and/or strength to the frame 100. As such, the frame 100 may comprise materials that are lighter and/or that have lower strength, such as lower Young's modulus of elasticity, than otherwise may be used for similar-sized frames (i.e., without the diffusers 150).

As described above, the diffusers 150 may diffuse the light produced by the lighting elements of the lighting assembly. Moreover, the diffusers 150 together with the lighting assembly and the frame 100 can form a lighted core 155 of the resin-based light fixture. In one example, the lighted core 155 can appear brighter and/or may have a higher intensity illumination than other elements or components of the resin-based light fixture (e.g., elements located farther away from the lighted core 155).

In one implementation, the manufacturer can cut, shape, and/or form the numerous diffusers 150 so as to form a desired three-dimensional shape when such diffusers 150 are coupled to the frame 100. More specifically, the diffusers 150 can couple to the structural members of the frame 100 so as to cover voids therebetween as well as to conceal the structural members. For example, the manufacturer can fasten the diffusers 150 to the structural members with mechanical fasteners, glue, or other fastening mechanisms. In one or more implementations, the diffusers 150 can form a substantially spherical shape when fastened to the frame 100.

To form the thermoplastic diffusers 150, a manufacturer can use one or more thermoplastic resin sheets 160 and may incorporate an inter-layer therebetween. For instance, a manufacturer can first choose the size and shapes of the thermoplastic diffusers 150. The manufacturer can then lay out the shapes on the thermoplastic resin sheets 160. Subsequently, the manufacturer also can cut the thermoplastic diffusers 150 out of the thermoplastic resin sheets 160. In some implementations, the manufacturer can perform these acts by hand. In alternative implementations, the manufacturer can use a CNC (computer numerically controlled) machine that can maximize the number of thermoplastic diffusers 150 to be cut from each thermoplastic resin sheet. In yet further implementations, the thermoplastic diffusers 150 can comprise, or be cut from, resin scraps from other projects.

After cutting the unshaped thermoplastic diffusers 150 from the thermoplastic resin sheets, the manufacturer can then heat the thermoplastic diffusers 150. For instance, the manufacturer can heat the thermoplastic diffusers 150 in an oven. Alternatively or additionally, the manufacturer can heat the thermoplastic diffusers 150 in a lamination press, autoclave, vacuum bag, or other thermosetting environment. In any event, the manufacturer can heat the thermoplastic diffusers 150 until they are pliable.

One will appreciate that the temperatures to which the manufacturer heats the thermoplastic diffusers 150 can be dependent upon the particular resins used to form the thermoplastic diffusers 150. For example, in implementations in which copolyester (e.g., PETG) is used, the manufacturer can place the thermoplastic diffusers 150 in an oven preheated to a temperature of about 350° F. for about one minute. In alternative implementations, the manufacturer can heat the thermoplastic diffusers 150 to a temperature of between about 180° F. and about 275° F., such as to a temperature of about 225° F. In any event, the manufacturer can heat the thermoplastic diffusers 150 to a temperature near or above their glass transition temperature.

Upon heating the thermoplastic diffusers 150, the manufacturer can shape the thermoplastic diffusers 150 into a desired shape or configuration. During the shaping, the manufacturer can impart curvature or other non-linear geometry to the thermoplastic diffusers 150. For example, the manufacturer can provide each of the thermoplastic diffusers 150 with varying degrees of flip, twist, and/or curvature. Accordingly, after shaping, the thermoplastic diffusers 150, in combination, can form a desired shape, when secured to the frame.

In one or more implementations, the thermoplastic diffusers 150 can have a gauge from as thin as about one-eighth inch (⅛") or one quarter inch (¼"), or thinner, to as thick as about one and one-half inches (1½") to about two inches (2"), or thicker, depending on the end-user's designs. In general, thicker gauges tend to be sturdier and more expensive than thinner gauges. In accordance with one or more implementations, the resin strips can have thinner gauges, such as anywhere from about one-sixteenth inch (1/16") to about three-eighths inch (3/8").

In at least one implementation, the resin-based light fixture also can include various decorative strips, panels, segments, and/or various articles, which may be secured to and/or about the lighted core 155. In particular, the strips, panels, segments, and/or other various articles can couple to the frame 100 and/or to the diffusers 150. More specifically, the resin-based light fixture can include fins 180 (e.g., fins 180*a* and/or fins 180*b*) secured to the lighted core 155 (e.g., to the diffusers 150 and/or to the frame 100). In particular, a manufacturer can secure the fins 180 to the diffusers 150 using rivets or other mechanical fasteners, such as fasteners 181. In at least one implementation, the fasteners 181 can match one or more colors of the adjacent or contacting surfaces secured by the fasteners 181.

In one or more implementations, the lighted core 155 can partially or wholly light or illuminate the fins 180. In particular, at least one implementation includes partially lighted fins 180, such that the viewer can observe an increased amount of light on, within, and/or through the fins 180 when the resin-based light fixture 200 is illuminated by the lighting assembly 140. Additionally or alternatively, the fins 180 can include portions that may be unlighted. For instance, end portions of the fins 180 may not receive light from the lighted core.

Moreover, the fins 180 can be shaped, bent, or otherwise configured to at least partially conceal the fasteners 181 and/or the fasteners 151. For instance, a portion of one of the fins 180 or multiple portions of the fins 180 may have bends, folds, curvature, and combinations thereof that may place the portion of the fins 180 over the fasteners 181 and/or fasteners 151, such as to conceal the fasteners 181 and/or fasteners 151 from a viewer. Accordingly, the fins 180 can improve aesthetic of the resin-based light fixture by at least partially covering or concealing the fasteners 181 and/or fasteners 151.

Furthermore, the fins 180 may at least partially conceal the frame 100 and/or the diffusers 150. In other words, the viewer may observe diffused light passing through the diffusers 150, while the diffusers 150 can be obscured or at least partially concealed from the viewer. Hence, the fins 180 may at least partially conceal the fasteners 181, fasteners 151, diffusers 150, and combinations thereof.

As described below in further detail, the fins 180 can have any number of suitable configurations, which may vary from one implementation to the next. For example, a single sheet or piece of thermoplastic resin may form two fins 180*a*. That is, the fins 180*a* may be coupled or integrated together, such that the fins 180*a* may connect to the lighted core 155 as a single unit. Alternatively, a single fin 180*b* may individually couple to the lighted core 155. It should be appreciated that any number of fins 180 may be coupled and/or integrated together and may form a single unit (similar to the fins 180*a*). Furthermore, the resin-based light fixture may include any number various configurations of the fins 180, which may vary from implementation to another (e.g., based on manufacturer's preference).

As described above, the lighted core 155 can provide filtered or tinted light. Likewise, in one implementation, fins 180 also can tint and/or or filter the light, as the light passes through the diffusers 150 and/or through the fins 180 (i.e., the light may exit the lighted core and/or the fins 180 having one or more different wavelengths than the light produced by the lighting elements). Furthermore, the one or more of fins 180 can incorporate a diffuser layer therein, which may provide additional diffusion as the light passes through the diffuser layer of the fins 180.

Figure 3:
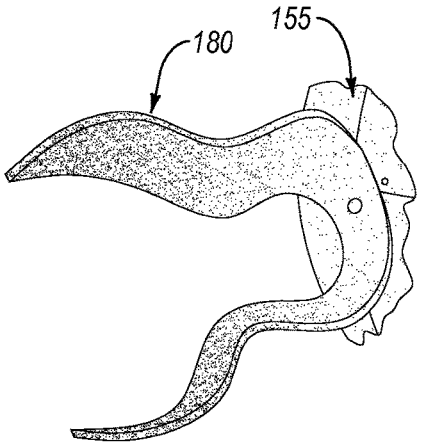
FIG. 3 illustrates a cutaway perspective view of an illuminated lighted core and fins in accordance with one implementation of the present invention.

As mentioned above, the resin-based light fixture may provide a higher intensity illumination at or near the lighted core 155. Moreover, as illustrated in FIG. 3, the resin-based light fixture may have a non-uniform light distribution or light intensity. For instance, the resin-based light fixture may have a light intensity gradient across various components or elements thereof. For example, the lighted core 155 may have a high intensity illumination, while the fins 180 may have low intensity illumination at the tips thereof. In addition, the fins 180 may have a gradient of light intensity that can include high intensity illumination near the portions closest to the lighted core 155 and low intensity or no illumination near the portions farthest away from the lighted core 155 (e.g., near the tips or ends of the fins 180).

Accordingly, in one example, the fins 180 together with the lighted core 155 may produce an effect of a lighted sphere with fanned out flames that grow dimmer toward the ends thereof. In additional or alternative implementations, however, the lighted core 155 and the fins 180 may have substantially the same or similar illumination. Furthermore, the fins 180 may incorporate one or more light guides. As such, implementations may include the fins 180 that have higher intensity illumination than the lighted core 155 (e.g., the lighted core 155 may include diffusers that dim the light passing therethrough and may have partial cutouts in the diffusers that allow the light from the lighting assembly to be transmitted directly to and through the light guide(s) of the fins 180). In any event, the manufacturer can vary light distribution across the lighted core 155 and/or the fins 180 as may be desirable or suitable in a particular implementation.

Figure 4:
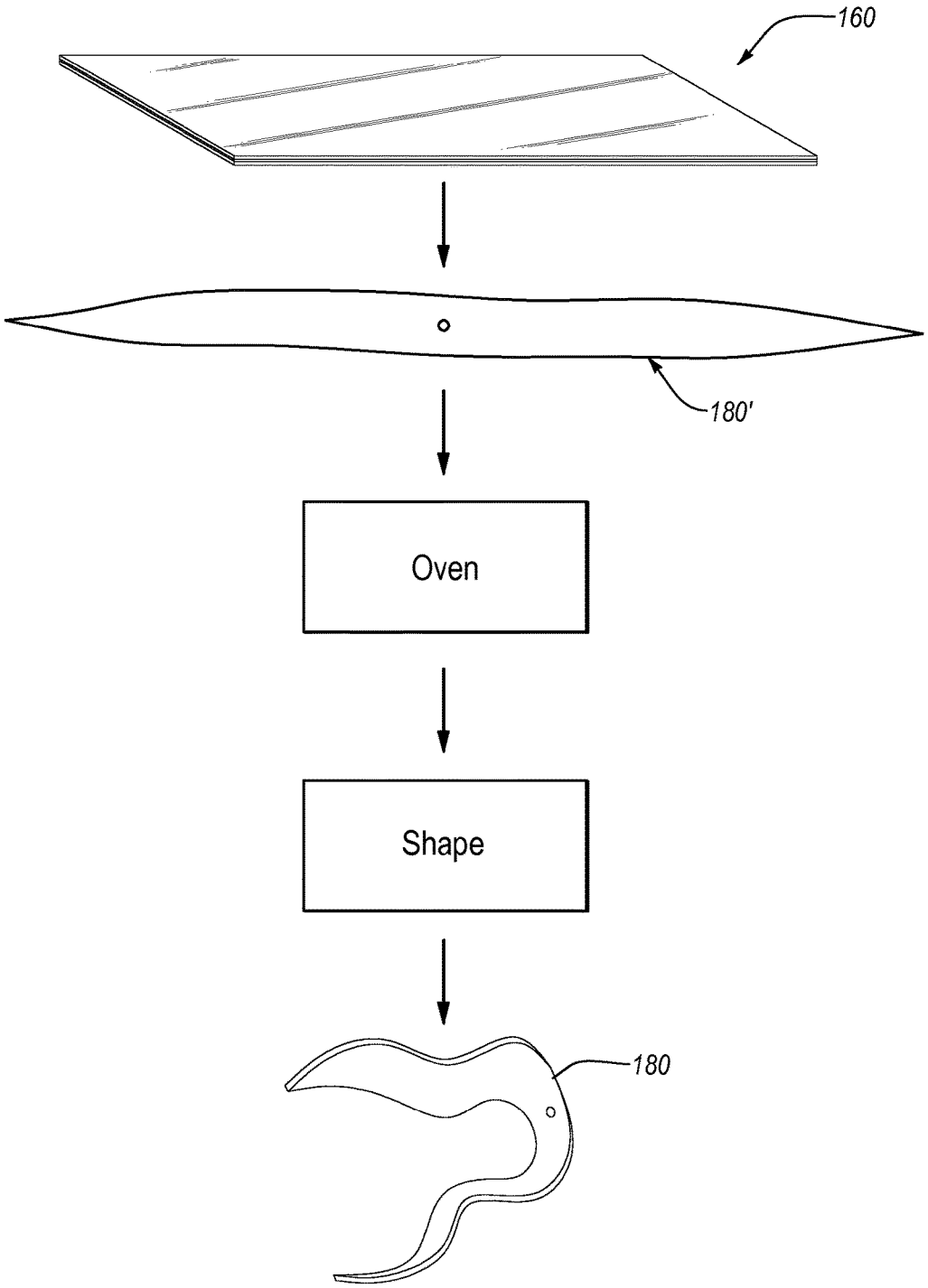
FIG. 4 illustrates a sequence of acts for fabricating a fin in accordance with one implementation of the present invention.

In at least one implementation, the fins 180 can comprise a thermoplastic resin material and can have the same or similar configuration or composition of such material as the thermoplastic diffusers 150 (e.g., the thermoplastic material comprising the fins 180 may include one or more interlayers). For instance, as illustrated in FIG. 4, a manufacturer can start with one or more desired thermoplastic resin sheets 160, which may be laminated. The thermoplastic resin sheets 160 also can comprise any number of inter-layers or decorative layers. The decorative inter-layers can comprise fabric, metallic wire, rods and/or bars, papers, or photographic images. In yet additional implementations, the decorative inter-layer can comprise any organic, inorganic, naturally occurring, or synthetic materials such as rocks, crushed glass, minerals, leaves, twigs, branches, grasses, bamboo shoots, willow, thatch reed, solidified resins, metallic objects, vegetation, and so forth.

Subsequently, the manufacturer can cut the thermoplastic resin sheets 160 into unbent fins 180'. The process of cutting and shaping the thermoplastic resin sheets 160 to form the fins 180 can be similar to or the same as the process of cutting and shaping the thermoplastic resin sheets 160 to form the diffusers, as described above. Thus, after the manufacturer cuts the thermoplastic resin sheets 160 into unbent fins 180', the manufacturer can heat the unbent fins 180' to a desired temperature, such that the unbent fins 180' can become pliable. Thereafter, the manufacturer can bend or shape the unbent fins 180' into desired shapes to produce the fins 180. Additionally, the manufacturer can perform such shaping and/or bending before or after securing or coupling the fins 180 to the frame 100 and/or to the diffusers 150 (FIGS. 2A-2B).

Figure 5A:
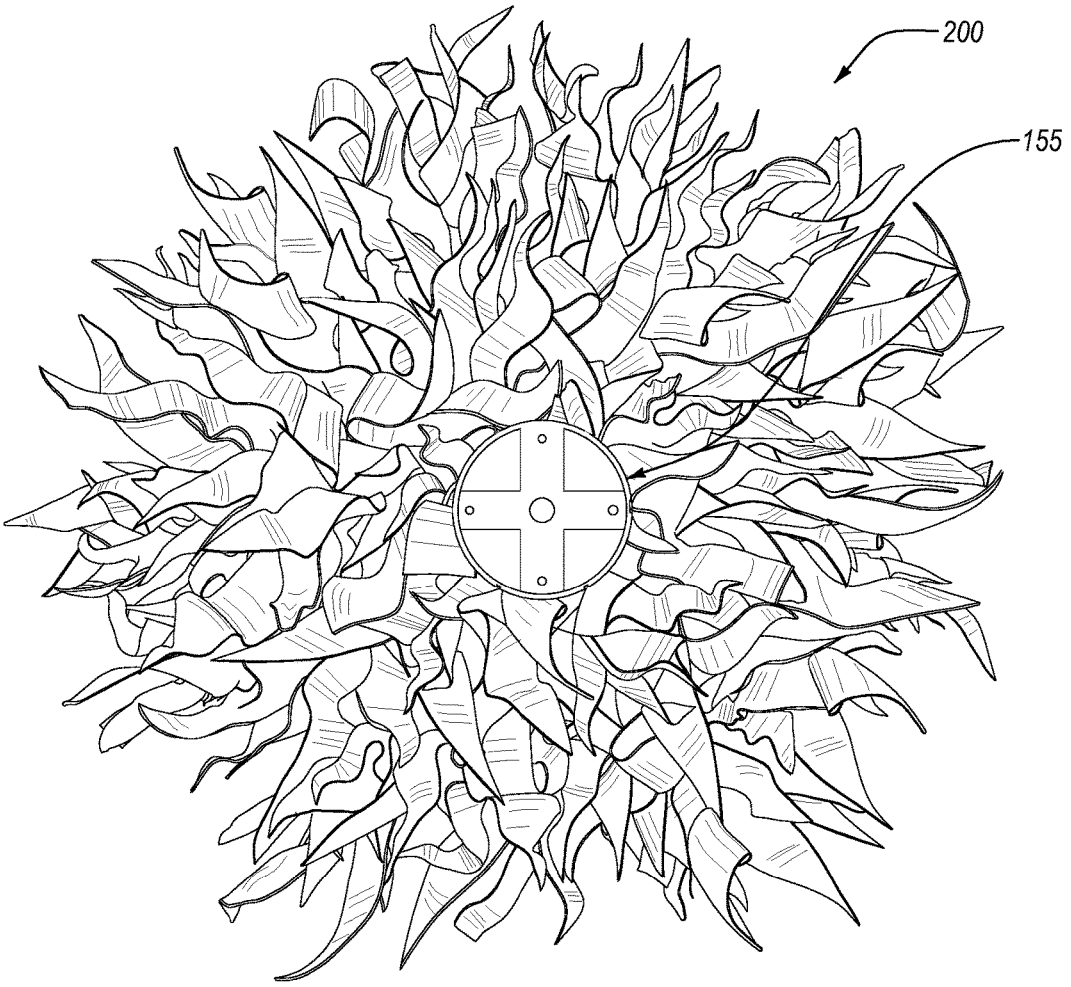
FIG. 5A illustrates a top view of a resin-based light fixture in accordance with one implementation of the present invention.
Figure 5B:
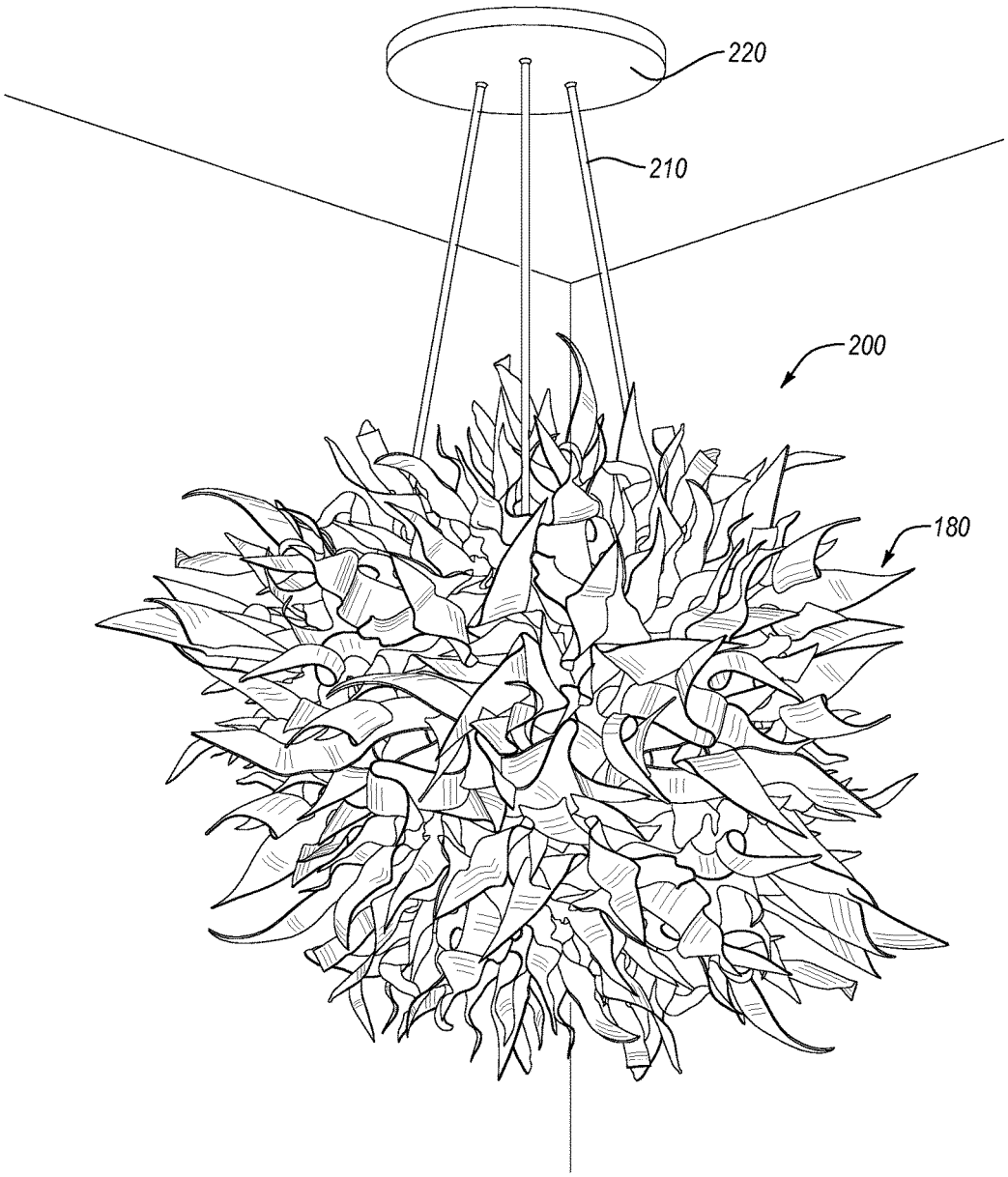
FIG. 5B illustrates a perspective view of the resin-based light fixture of FIG. 5A.

In any event, the manufacturer can secure the fins 180 about the lighted core 155 to form a resin-based light fixture 200, as illustrated in FIGS. 5A-5B. As mentioned above, in one implementation, the fins 180 may overlap, bend and/or twist over one another, tangle together, and may have various combinations of such configurations. In any event, however, the fins 180 can at least partially or entirely conceal the lighted core, the lighting assembly (and its components or elements), as well as the frame of the resin-based light fixture 200 from the viewer. Accordingly, the resin-based light fixture 200 can provide a pleasing aesthetic to the viewer and may enhance or emphasize the aesthetic of the thermoplastic panels or materials used in the fins 180 and/or in the lighted core.

Furthermore, the manufacturer can secure fins 180 to other fins 180, thereby creating a multi-layered resin-based light fixture 200. The multi-layered resin-based light fixture 200 may incorporate a frame, one or more diffusers, and a plurality of fins 180. For example, the manufacturer can attached fins 180 to or about the lighted core, such that the fins 180 overlap one another forming multiple layers of the resin-based light fixture 200. Moreover, the manufacturer can secure any of the fins 180 at two or more locations, such that the fins 180 can have portions that protrude outward from the lighted core. Accordingly, in one implementation, the manufacturer can shape the fins 180 about the lighted core in a manner that at least one of the fins 180 has a shape substantially similar to the shape of the frame and/or of the lighted core.

In one or more implementations, the overall shape of the resin-based light fixture 200 may, at least in part, depend on the shape of the frame 100 (FIG. 1). For instance, the spherical frame, described above, can support various elements (e.g., the fins 180) that may form a substantially sphere-like resin-based light fixture 200. In other words, the fins 180, when combined can form a shape similar or substantially the same as the shape formed by the frame 100 (FIG. 1).

Alternatively, however, elements of the resin-based light fixture can mask the shape of the frame 100 and/or can form light fixtures that may appear and/or have a shape that is different from the shape of the frame 100. Additionally, the fins 180 can have various shapes and sizes, which can define the shape of the resin-based light fixture 200 formed by the fins 180, together with the frame and/or diffusers. The various shapes formed by the fins 180 can further enhance the aesthetic appeal of the resin-based light fixture 200.

In addition, the fins 180 can have various colors, which may conjure a particular correlation between the resin-based light fixture 200 and an object known to the viewer. For instance, the fins 180 can have a flame-like appearance. More specifically, the fins 180 can have tapered ends and can have various, alternating bends and/or twists, which may appear as waves to the viewer. Additionally, the fins 180 can have various red and yellow colors and shades, such that can relate an appearance or representation of flames or flares to the viewer.

Similarly, the diffusers can include various colors, which can simulate or represent an appearance to the viewer of a known object or entity. Moreover, the combination of the fins 180 and the diffusers can form the resin-based light fixture 200 that has a representation or likeness of a known object. For example, the resin-based light fixture 200 can appear like or represent the sun.

An installer can secure the resin-based light fixture 200 to a support surface in any number of ways, which may vary from one implementation to the next. In one example, at one end, the installer can secure one or more cables 210 to the resin-based light fixture 200 or a portion thereof, such as the frame, and secure the cables 210 to the support surface at another end. For instance, the installer can secure the cables 210 to a plate 220 that, in turn, can be secured to the support surface. Furthermore, the lighting assembly can receive power from a main power supply. Thus, the installer can connect a power cable to the main power supply and to the lighting assembly.

Figure 6:
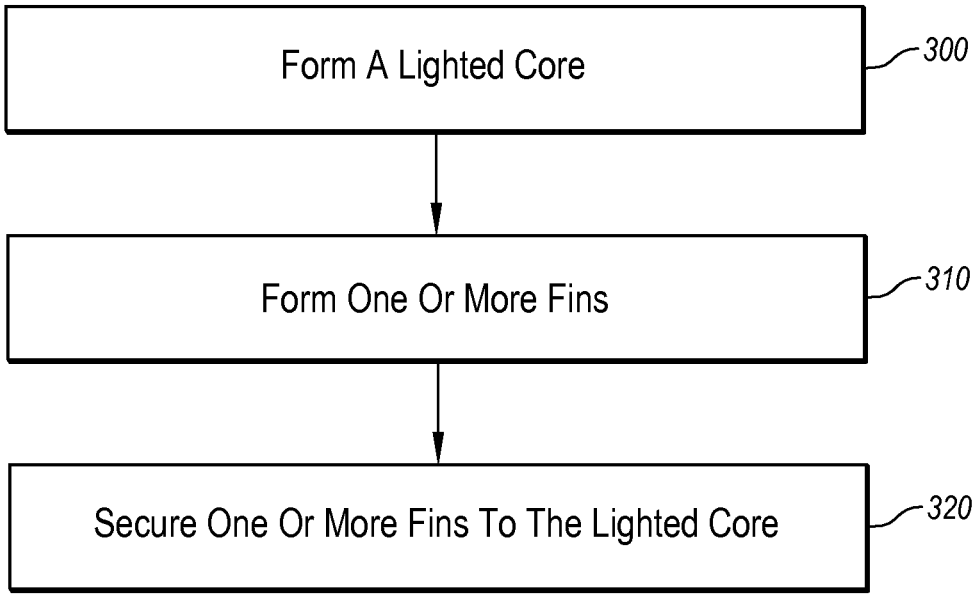
FIG. 6 illustrates a chart of acts of a method of manufacturing a resin-based light fixture in accordance with one implementation of the present invention.

Accordingly, FIGS. 1-5B as well as the corresponding text provide a number of different implementations of the resin-based light fixture and components and elements thereof. In addition to the foregoing, implementations of the present invention can also be described in terms of flowcharts comprising acts and steps in a method for accomplishing a particular result. For example, FIG. 6 illustrates a flowchart of one exemplary method for producing a resin-based lighting fixture, such as the resin-based light fixture 200 (FIG. 5A-5B), using principles of the present invention. The acts of FIG. 6 are described below with reference to elements, components, and diagrams of FIGS. 1 through 5B.

For example, the method may include an act 300 of forming a lighted core 155 of the resin-based light fixture 200. In one implementation, the lighted core 155 may include the frame 100 and one or more diffusers 150 secured to the frame 100. The frame 100 may include multiple structural members 110 connected together to form a three-dimensional shape of the frame 100, which may have an internal space that can house the lighting assembly 140. In one or more implementations, the manufacturer can form the structural members 110 from any suitable materials, which may have any number of cross-sectional shapes and/or sizes. For instance, the manufacturer can bend and/or shape bars, tubes, or other elongated members to form the structural members 110, which can be connected or secured together to from the frame 100.

In addition, the lighted core 155 can include diffusers 150 that may diffuse, scatter, or spread out light produced by the lighting assembly 140. The manufacturer can cut, heat, and shape thermoplastic resin sheets 160 to form the diffusers 150, as described above. Thereafter, the manufacturer can secure the diffusers 150 to the frame 100 (e.g., the manufacturer can fasten the diffusers 150 to the structural members 110 of the frame 100).

The method also may include an act 310 of forming one or more fins 180, which may be incorporated into the resin-based lighting fixture 200. As described above, the fins 180 may be formed from one or more thermoplastic resin sheets 160. Particularly, the manufacturer can cut, heat, and shape the thermoplastic sheets 160 to form the fins 180. In one implementation, the manufacturer may manually shape at least some the unbent fins 180' to fabricate unique fins 180, which may be substantially distinct one from another. Hence, the resin-based light fixture 200 may be unique or custom made, which may be desirable for end-users. In additional or alternative implementations, the manufacturer can shape at least some of the unbent fins 180' in an automated or semi-automated manner (e.g., using molds, dies, etc., to press and shape the unbent fins 180').

The method also may include an act 320 of securing the fins 180 to or about the lighted core 155. More specifically, in at least one implementation, the manufacturer may secure the fins 180 to the diffusers 150. Accordingly, the manufacturer may secure the fins 180 substantially anywhere on and/or around the lighted core 155. Additionally or alternatively, the manufacturer may secure the fins 180 to the structural members 110 of the frame 100 and/or to the diffusers 150.

Furthermore, the manufacturer may connect the fins 180 to and/or about the lighted core 155 in a single layer or in multiple layers. For instance, the manufacturer may connect one or more fins 180 over and/or on top of other fins 180. In any event the fins 180 may at least partially cover or conceal the diffusers 150 as well as connecting hardware, such as fasteners, that may secure the diffusers 150 to the frame 100. Likewise, the fins 180 may cover and/or conceal the fasteners that secure the fins 180 to the diffusers 150 and/or to the structural members 110 of the frame 100.

Although the acts or steps of the method are presented in a particular sequence, it should be appreciated that the sequence of the acts or portions thereof described herein may vary from one implementation to another. For instance, in one or more implementations, the manufacturer may at least partially perform the act 310, such as cutting the thermoplastic resin sheets 160 to form unbent fins 180'. Thereafter, the manufacturer may secure the unbent fins 180' to the diffusers 150 and/or to the frame 100. Subsequently, the manufacturer may heat and shape the fins 180 to a desired shape or configuration.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A resin-based hanging light fixture, comprising:

a frame including a plurality of structural members that define an internal volume of the frame;

one or more lighting elements secured within the internal volume of the frame;

a plurality of diffusers secured to the frame in a manner that the each of the diffusers surrounds the one or more lighting elements and generally follow a contour or shape of the frame, wherein the diffusers comprise translucent thermoplastic sheets of from about 1/16" thick to about 2" thick, wherein the frame, one or more lighting elements, and plurality of diffusers form a lighted core; and a plurality of fins, each fin being secured by one or more fasteners to at least one of the plurality of diffusers at a single point of attachment at a proximal end;

wherein each fin comprises opposing proximal and distal ends, the proximal end being secured via the one of more fasteners to at least one of the plurality of diffusers, with the distal end comprising a free end with no attachment to the diffuser, the free, distal end extending outward from the plurality of diffusers to a terminating point, each fin tapering in the direction of extension and including one or more bends or twists between the attached proximal end and the free, unattached distal end;

each fin comprises two or more layers of thermoplastic sheet melted together;

wherein the combination of the plurality of fins and lighted core creates a sun-like shape, wherein the shape of each fin provides a different illumination gradient along the entire length of the corresponding fin compared to a next adjacent fin, thereby providing multiple different illumination gradients extending outwardly, away from the frame;

wherein the plurality of fins entirely conceal the lighted core.

2. The resin based hanging light fixture as recited in claim 1, wherein each diffuser of the plurality of diffusers is secured to the frame with multiple fasteners.

3. The resin based hanging light fixture as recited in claim 2, wherein the plurality of fins at least partially conceal the one or more fasteners.

4. The resin based hanging light fixture as recited in claim 1, wherein at least two or more of the plurality of fins overlap one another or tangle together.

5. The resin based hanging light fixture as recited in claim 1, wherein one or more diffusers of the plurality of diffusers include a translucent suede.

6. The resin based hanging light fixture as recited in claim 1, wherein the plurality of diffusers comprise two or more thermoplastic resin sheets.

7. The resin based hanging light fixture as recited in claim 1, wherein each fin comprises two or more thermoplastic resin sheets.

8. The resin based hanging light fixture as recited in claim 1, wherein the frame includes an access door secured to at least one structural member of the plurality of structural members, the access door being operable to provide access to the internal volume of the frame.

9. The resin based hanging light fixture as recited in claim 1, wherein:

the plurality of fins comprises fins of multiple different shapes;

at least one of the fins in the plurality of fins differs in shape from at least one neighboring fin in the plurality of fins; and the different shapes of fins in the plurality correspondingly provide multiple different illumination gradients extending outwardly from the plurality of diffusers.

10. The resin based hanging light fixture as recited in claim 1, further comprising:

a lowering pulley system that includes at least one pulley, and a cable coupled to the resin-based hanging light fixture;

wherein the cable attaches to an anchor positioned inside the frame.

11. The resin based hanging light fixture as recited in claim 10, wherein the at least one pulley is attached inside the frame.

12. An illuminated resin-based hanging light fixture having a non-uniform illumination intensity, the illuminated resin based hanging light fixture comprising:

a lighted core including a frame having one or more illuminated lighting elements secured within the frame the frame defining an at least hemi-sphere-like shape having a diameter of about 13" in at least one point; and one or more diffusers secured to one or more of an outside and an inside of the frame, wherein the one or more diffusers generally follow a contour or shape of the frame, and comprise thermoplastic sheets of from about 1/16" thick to about 2" thick;

a plurality of resin fins positioned about the lighted core and secured via one or more fasteners on a proximal end to the one or more diffusers, the plurality of resin fins extending away from the lighted core, the plurality of resin fins twisting and tapering in the direction of extension along a length of at least about 10", each fin comprising two or more layers of translucent thermoplastic sheets melted together, such that each fin comprises a thickness of about 1/16" to about 3/8"; and wherein:

the lighted core has a first color and a first intensity of illumination;

at least a portion of each of the plurality of resin fins has a second color and a second intensity of illumination; and the first intensity of illumination is different from the second intensity of illumination;

wherein each fin provides a different illumination gradient along the entire length of the corresponding fin compared to a next adjacent fin, thereby providing multiple different illumination gradients extending outwardly, away from the frame;

wherein the plurality of resin fins entirely conceal the lighted core.

13. The illuminated resin based hanging light fixture as recited in claim 12, wherein the first color is different from the second color.

14. The illuminated resin based hanging light fixture as recited in claim 12, wherein one or more end portions of the plurality of resin fins are substantially un-illuminated.

15. The illuminated resin based hanging light fixture as recited in claim 12, wherein the plurality of resin fins include an illumination gradient having a higher illumination intensity of portions closer to the lighted core and having a lower illumination intensity of portions farther away from the lighted core.

16. The illuminated resin based hanging light fixture as recited in claim 12, wherein the first illumination intensity is higher than the second illumination intensity.

17. The illuminated resin based hanging light fixture as recited in claim 12, wherein end portions of the plurality of resin fins collectively define a shape that is approximately the same as a shape of the lighted core.

18. The resin based hanging light fixture as recited in claim 12, wherein:

the plurality of fins comprises one or more fins of a first shape that differs from a shape of another one or more fins in the plurality of fins;

at least one of the fins in the plurality of fins differs in shape from at least one neighboring fin in the plurality of fins; and the different shapes of fins attached to the one or more diffusers provide the corresponding multiple different illumination gradients.

19. The resin based hanging light fixture as recited in claim 12, further comprising:

a lowering pulley system that includes at least one pulley, and a cable coupled to the resin-based hanging light fixture;

wherein the cable attaches to an anchor positioned inside the frame.

20. The resin based hanging light fixture as recited in claim 19, wherein the at least one pulley is attached inside the frame.

21. A method of manufacturing a resin-based light hanging fixture, the method comprising the steps of:

forming a frame that includes a plurality of structural members connected together to form an internal volume of the frame;

securing a lighting assembly within the internal volume of the frame;

securing one or more diffusers to the frame in a manner that the one or more diffusers at least partially bend around and surround the lighting assembly and generally follow a contour or shape of the frame, the one or more diffusers comprising of translucent thermoplastic sheets of from about 1/16" thick to about 2" thick;

securing a plurality of fins to the one or more diffusers via corresponding one or more fasteners so as to entirely conceal the frame, lighting assembly, and one or more diffusers with the plurality of fins, each fin comprising two or more layers, wherein at least one of the layers includes a thermoplastic sheet;

heat forming a plurality of thermoplastic sheets to create one or more precursor sheets;

cutting out the one or more fins from the one or more precursor sheets, wherein each fin has a length of about 10" or more;

shaping the one or more fins to include one or more bends or twists; and wherein securing the plurality of fins further comprises attaching a single, proximal end of the shaped one or more fins to the one or more diffusers via the one or more fasteners;

wherein the shape of each fin provides a different illumination gradient along the entire length of the corresponding fin and compared to a next adjacent fin.

22. The method as recited in claim 21, wherein the step of shaping the one or more fins further comprises forming the one or more fins by cutting one or more thermoplastic resin sheets and heating the one or more cut thermoplastic resin sheets.

23. The method as recited in claim 21, wherein the step of securing one or more diffusers to the frame comprises fastening the one or more diffusers to one or more structural members of the plurality of structural members with one or more of rivets, screws, bolts, or staples.

24. The method as recited in claim 23, wherein the step of shaping the one or more fins further comprises concealing one or more of the one or more diffusers and the one or more of rivets, screws, bolts, or staples that secure the diffusers to the one or more structural members.

25. The resin based hanging light fixture as recited in claim 21, further comprising:

a lowering pulley system that includes at least one pulley, and a cable coupled to the resin-based hanging light fixture;

wherein the cable attaches to an anchor positioned inside the frame.

26. The resin based hanging light fixture as recited in claim 25, wherein the at least one pulley is attached inside the frame.

* * * * *